United States Patent [19]

Carr

[11] Patent Number: 4,731,125

[45] Date of Patent: Mar. 15, 1988

[54] MEDIA BLAST PAINT REMOVAL SYSTEM

[76] Inventor: Lawrence S. Carr, 150 Silvarado Trail-#53, Napa, Calif. 94559

[21] Appl. No.: 767,696

[22] Filed: Aug. 21, 1985

Related U.S. Application Data

[63] Continuation of Ser. No. 601,805, Apr. 19, 1984, abandoned.

[51] Int. Cl.[4] ..... B08B 7/00

[52] U.S. Cl. ..... 134/17; 134/38; 51/298; 51/320

[58] Field of Search ..... 134/7, 38; 51/320, 298

[56] References Cited

U.S. PATENT DOCUMENTS

| | | | |
|---|---|---|---|
| 1,916,633 | 7/1933 | Mulvany et al. | 134/7 |
| 2,426,072 | 8/1947 | Wall et al. | 134/7 X |
| 2,710,286 | 6/1955 | Zachariason | 51/320 X |
| 3,424,616 | 1/1969 | Townsend | 51/320 X |
| 3,485,671 | 12/1969 | Stephens | 134/7 |
| 3,716,066 | 2/1973 | Currier et al. | 134/7 |
| 3,833,416 | 9/1974 | Fleischer | 134/38 X |
| 3,985,572 | 10/1976 | Petermann et al. | 134/34 |

FOREIGN PATENT DOCUMENTS

| | | | |
|---|---|---|---|
| 58-73585 | 5/1983 | Japan | 134/7 |
| 874720 | 8/1961 | United Kingdom | 134/7 |

*Primary Examiner*—Helen M. S. Sneed
*Assistant Examiner*—Sharon T. Cohen
*Attorney, Agent, or Firm*—David C. Ripma

[57] ABSTRACT

A method is described for blast cleaning paint and other adhesive coatings from composite surfaces formed of a reinforced matrix material. A special soft media is used at a relatively low pressure to prevent damage to the soft composite material. The preferred method calls for the use of a media having a Mohs scale hardness number of 3.0 or less. The media is pressurized to approximately 40 p.s.i. and directed at the composite surface to be cleaned. A method of optimizing the cleaning action is also described.

13 Claims, 2 Drawing Figures

MEDIA BLAST PAINT REMOVAL SYSTEM

This is a continuation of Ser. No. 601,805, filed Apr. 19, 1984, now abandoned.

BACKGROUND OF THE INVENTION

This invention relates generally to systems for removing adherent material, such as paint or other coverings, from surfaces, and more particularly to nonchemical surface cleaning systems employing mechanical blast.

For various types of structures and equipment, it is often necessary or desirable to remove the layer or layers of coatings which have been applied to surface areas. Numerous techniques exist for removing paint, sealants, lacquers and other adherent materials from virtually any type of surface. Surface cleaning or stripping methods range from mechanical abrasion to the use of strong chemicals, and involve varying degrees of time, effort and expense. For any given type of coating, the character and function of the substrate material from which a coating is to be removed ususally dictates the stripping method, at least in industrial settings. Hard, durable surfaces, such as heavy steel plating, can be cleaned or stripped by relatively fast abrasive methods, such as sand blasting. More delicate surfaces may require careful chemical removal to prevent damage or destruction of the substrate.

A certain class of materials, generally called composites, present special problems which have heretofore required the use of expensive and hazardous chemical treatments to remove surface coatings. Composites are usually made of a matrix material, such as plastic or epoxy, which often contains fibers such as glass strands, graphite, kevlar or the like for reinforcement. Layers of the material are laminated together or pressed onto a honeycomb base to form structural material. Composites are strong and light and are increasingly used in aircraft and other manufactured products where weight savings are important. Because composites usually have surfaces which are softer than metals, removal of paint or other coatings from composites must be done carefully to avoid excessive abrasion or chemical damage.

The greatest costs in both time and money associated with stripping and cleaning composites are probably encountered in the maintainance of modern aircraft, which incorporate large areas of exterior surface formed of composites. Airlines and the military spend large amounts chemically stripping paint and other coatings from aircraft, in preparation for repainting. The weight savings from stripping generally justifies the enormous expenditure in man-hours to strip an aircraft using chemicals and sanding.

Recent developments have indicated the effectiveness of a new stripping technique, similar to sand blasting, which is quicker and safer than chemical stripping. The system uses a granular media consisting of numerous particles of a plastic material accelerated to high speed and directed against the surface to be cleaned. The media particles can be of various sizes, depending on the application, and can be accelerated to produce a continuous media flow using conventional sand blasting equipment. This system has been shown to be highly effective in removing paint and other coatings from harder surfaces, such as metal, and also for deburring and other finishing processes and the like. It is far safer than chemical stripping, presents no hazardous waste disposal problems, and greatly reduces the man-hours and expense of surface cleaning. Blast cleaning with plastic media has been shown to be effective on the metal parts of aircraft, but was not previously considered suitable for stripping composites. Due to the relative softness of composites, as compared to metal, plastic media blast cleaning by prior art methods tended to score, abrade or otherwise damage composite surfaces to an unacceptable degree. Until the development of a blast cleaning method which solves such problems, aircraft and other surfaces made of composites have had to be cleaned and stripped by laborious and expensive prior art techniques.

It would be advantageous to have a less hazardous and more economical method of cleaning and stripping composite surfaces. The use of blast cleaning techniques for cleaning composites would be especially desirable since it would greatly reduce the cost and time for such cleaning. Any blast cleaning method used on composites must, however, not result in damage to the composite surface.

SUMMARY OF THE INVENTION

Accordingly, the present invention provides a surface cleaning method for removing adherent material from composite surfaces formed of a reinforced matrix material. Steps in the method include the provision of a granular media substantially composed of particles of a material which has a Mohs scale hardness number lower than 3.5. The media is then accelerated using media propelling means to produce a substantially continuous media flow at a media outlet having a pressure of approximately 40 pounds per square inch or less at the media outlet. The media is directed at a target composite surface to be cleaned. Adherent material is removed from the target composite surface by the action of the media without damage to the composite surface.

In its preferred form, the method includes the use of a flexible tube and nozzle to direct the media at the target composite surface. The media flow is directed at a selected angle with respect to the composite surface to optimize the cleaning action. Steps are also set forth which minimize the possibility of damage to the underlying composite surface.

DETAILED DESCRIPTION OF THE PREFERRED EMBODIMENT

Figure 1:
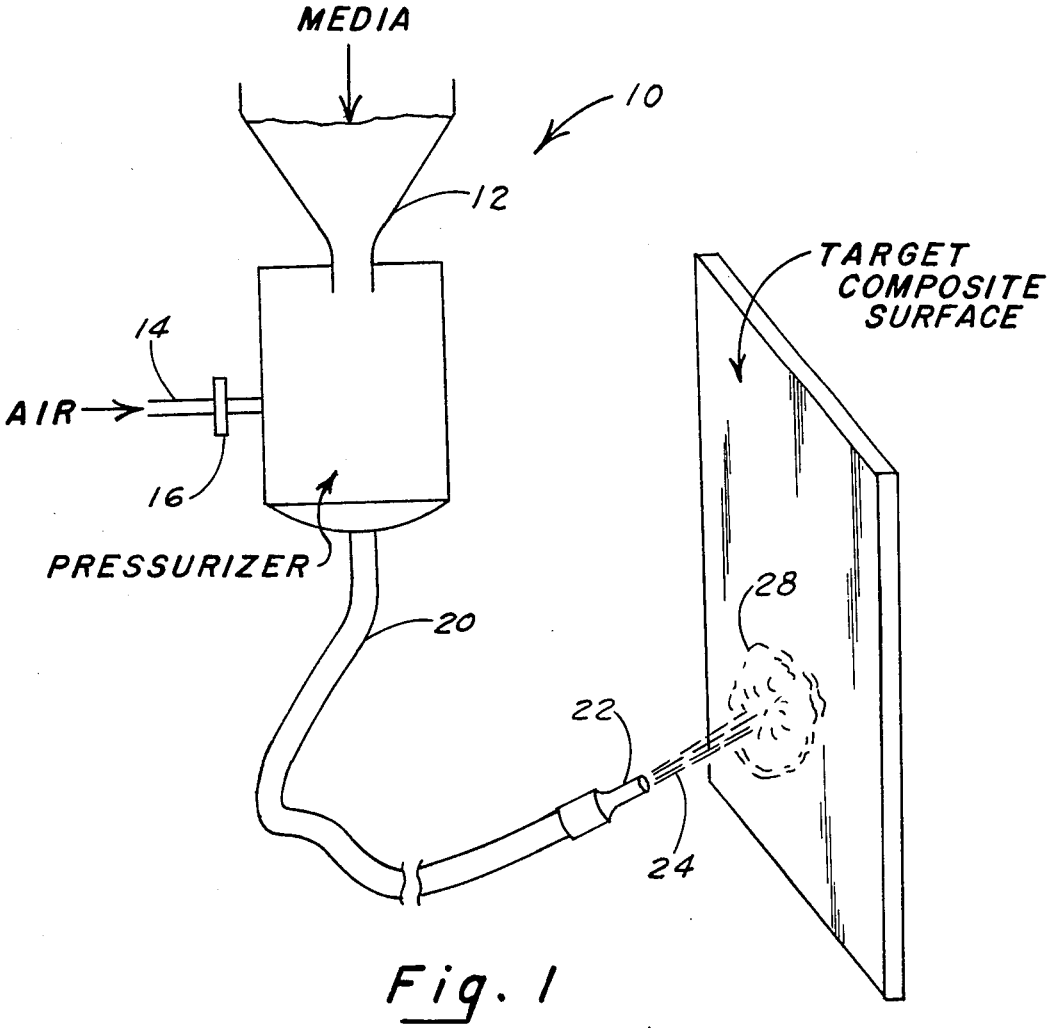
FIG. 1 is a partially schematic plan view of a system for performing the media blast surface cleaning method of the present invention.

The present invention is specifically directed to media blast cleaning of composite surfaces made up of a reinforced matrix material, and provides a system for removing paint and other coatings from such surfaces. As discussed above, the term composites, as used herein, refers to a class of increasingly important structural materials which possess the qualities of strength and lightness. "Reinforced matrix material" describes the general configuration of composites, in which reinforcing fibers are embedded in a matrix of polyester, polyurethane, vinyl ester, epoxy resin or another suitable matrix. The reinforcing fibers can be formed of graphite, glass, Kelvar (trademark) or other equivalent fibers. The making of structural panels or shapes from composites generally includes bonding layers of the reinforced matrix sheets onto a honeycomb core, resulting in a tough, strong and lightweight material which resists impact and corrosion. If the honeycomb core is absent, the composite is fabricated as a solid laminate.

Despite their strength, composites have a relatively soft surface, compared to most metals, and are susceptible to wear and damage through abrasion. For this reason, prior art blast cleaning methods such as sand blasting cannot be used to remove adherent coatings from composites. The cleaning system of the present invention provides a method of cleaning and stripping composites which avoids damaging the relatively soft surface while permitting the use of efficient blast cleaning techniques.

A first step in the method is to provide a suitable blast cleaning media. It has been discovered that the most effective media for use on composites, which avoids surface damage when properly applied, is a plastic media with very specific properties. The media is composed of particles of a material having a Mohs scale hardness mumber of approximately 2.5 to 3.0. Particle hardness should not exceed a Mohs hardness of 3.5, as this has been found to damage composite surfaces. Plastic has been found to be the most suitable material for the media. Urea formaldehyde or another thermoset plastic can readily be formed into granular particles for this purpose. A Mohs hardness of 3.0 is substantially softer than other blast media, such as sand, which has a Molus hardness of 7. It is the relative softness of the media, in combination with the method desribed below, which prevents damage to composite surfaces. A suitable commercially available media which can be used with the present invention is Polyextra (trademark) Blast Cleaning Media, manufactured by the U.S. Plastic and Chemical Corporation.

Blast media such as Polyextra are generally classified as to particle size by U.S. standard sieve sizes. While it is not believed to be critical, media with a sieve size of 20–30 is known to be suitable for use with the present invention. It is anticipated that media having sieve sizes ranging from 12–16 to 60–80 can be used, with the selection of the size being based on the particular application.

The next step in the method is to accelerate the media to a flow which is effective for blast cleaning. Acceleration can be accomplished by a suitable media propelling means, such as a pneumatic sand blaster, or similar device. Preferably, the media propelling means will have a movable media outlet such as a nozzle, which allows the media flow to be directed over a target composite surface area to be cleaned. The media propelling means should produce an output pressure for the media flow of approximately 40 pounds per square inch (p.s.i.). That is a lower pressure than is used in most sand blasting operations. Conventional sand blasters can often be modified to output media at 40 p.s.i. by a simple adjustment, or, in some cases, by the addition of a pressure regulator to the equipment. Although the pressure of the media flow need not be exactly 40 p.s.i. to practice the present invention, it is important that pressures substantially higher than 40 p.s.i. not be used since higher pressures tend to damage composites. A suggested range for the pressure of the media flow at the output nozzle is between 35 and 45 p.s.i.

FIG. 1 illustrates a typical configuration for practicing the present invention. Pressure blast cleaning equipment is illustrated generally at 10. An example of such equipment suitable for use with the present invention is the pressure blast cleaning equipment manufactured by Clemco Industries. Such equipment includes a reservoir of media 12 to be accelerated. Pneumatic pressure blast cleaners also include an inlet line 14 from a source of pressurized air or other gas (not shown). A pressure regulator 16 may also be provided to reduce the inlet pressure supplied through line 14. The outlet from media propeller 10 includes a long flexible tube or hose 20 through which the pressurized media flows. At the end of hose 20 is a nozzle 22 which serves as a media outlet and as a means for directing the media flow 24 emerging from the nozzle. The media flow 24 will be a mixture of pressurized air or other pressurizing gas and the media particles, which will emerge in high volume and at relatively high speed. For the purposes of practicing the present invention, media flow 24 will be substantially continuous and have a pressure at nozzle 22 of approximately 40 p.s.i.

The diameter of nozzle 22 determines the diameter of media flow 24. A larger nozzle size requires a greater volume of pressurized air at inlet line 14 and produces a correspondingly larger volume of media flow at nozzle 22. Nozzle sizes of ¼ inch and ½ inch have been proved effective with the present invention, although larger sizes can be used if pressure blast equipment of sufficient capacity is available. Regardless of the nozzle size, it is anticipated that the media flow will be confined by nozzle 22 to a diameter which is substantially smaller than the size of the target composite surface 28 to be cleaned. As such, the media flow will be directed over the target composite surface in the manner described below in order to remove adherent material from surface 28.

Directing media flow 24 at the target composite surface constitutes the next step in the method of the present invention. It is anticipated that in most applications of the present invention the surface to be cleaned will be stationary and the nozzle will be moved to clean the surface. For example, in cleaning composite surfaces on an aircraft fuselage or the like, a person holding the nozzle will direct the media flow over the target surface in a varying manner until the surface is cleaned.

Figure 2:
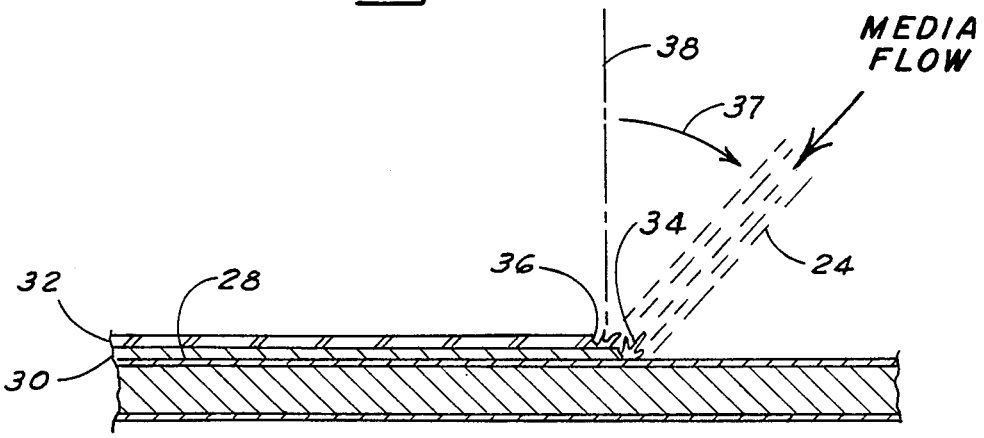
FIG. 2 is a magnified cross-sectional view illustrating the removal of adherent layers from a composite substrate in accordance with the present invention.

In order to remove paint and other adherent material efficiently from composite surfaces, it is preferable that the path of the media flow against the target surface be optimized. An optimal path of media flow will be one in which the angle and direction of the media flow produces highly efficient removal of adherent material from the surface without damage to the composite surface. This is generally done by angling the media flow away from a perpendicular direction with respect to the target surface so that the leading edge of the coating being removed is exposed to the force of the media flow. FIG. 2 illustrates an optimal path of media flow with respect to a target composite surface 28. Assuming there are two adherent layers of paint 30 and 32 to be removed from surface 28, an optimal path of media flow will be approximately as shown in FIG. 2. The media flow will be directed at the leading edge 34 of layer 30 and also against leading edge 36 of layer 32. The angle 37 of the media flow with respect to perpendicular 38 is increased to increase the rate of removal of layers 30 and 32. It has been found that an increase in angle 37 results in more media particles being available to dislodge the adherent layers at the leading edge. For this reason, it is preferred that angle 37 be increased until the observed effectiveness of the removal action is maximized, and that angle then becomes the optimal path of media flow.

Another preferred step in the cleaning process is the efficient redirection of the media flow over the target composite surface until the entire surface is cleaned. It has been found that this is best accomplished by directing the media flow primarily at areas of adherent material remaining to be removed, and then redirecting the media flow to other unremoved areas whenever removal in the first area is substantially accomplished. In this way, exposure of cleaned, and therefore unprotected, composite surface to the full force of the media blast is minimized. During the entire cleaning process, an optimal path or angle of media flow is preferably maintained. Only at the start of the cleaning process or at other times when obstructions prohibit selection of an angle for the media flow will it be best to keep the media flow perpendicular to the target surface. At other times, the maintenance of an optimal path in response to the observed effectiveness of action of the media flow will produce the most efficient and effective surface cleaning action by the media flow.

The above-described process for the removal of adherent material from composite surfaces has proven to be superior to prior art surface cleaning techniques. Media blast eliminates entirely the need to use hazardous chemicals for surface cleaning. Not only is there a substantial savings of both time and labor, but the health, safety, pollution and disposal problems associated with chemical paint stripping are entirely eliminated. Other advantages of composite surface cleaning by the present invention include the ability to selectively remove outer layers of material while having underlying layers intact. This can be done by carefully directing the media flow at an area only until the desired layers are removed, leaving remaining layers intact. While such selective removal cannot be performed in some circumstances, such as where an underlying layer is too soft to remain intact, it is virtually impossible to perform selective removal with chemicals.

The composite surface cleaning system can be modified to meet the needs of particular situations. For example, the blast pressure media particle size and angle of media flow can all be modified within the limits described above in order to facilitate efficient cleaning without damage to the composite surface. Small or angled nozzles can be employed in confined areas or to reach otherwise inaccessible parts of a composite surface. Other modifications within the scope of this invention include the use of other types of media propelling means or of other means to direct the media flow.

The invention provides a less hazardous and more economical method of cleaning and stripping paint and other adherent materials from composite surfaces. The method allows for the use of efficient blast cleaning techniques without damage to relatively fragile composite surfaces.

What is claimed is:

1. A method of removing paint from the surface of composite structural material which is formed of bonded layers of a fiber reinforced matrix, in which the matrix is a type of material selected from the group consisting of polyester, polyurethane and epoxy and the reinforcing fibers are strands selected from the group consisting of glass, graphite and Kevlar, the method comprising the steps of: providing a granular plastic media consisting of particles of plastic material having a Mohs scale hardness number in the range of 2.5 to 3.5, accelerating said media using media propelling means to produce a substantially continuous media flow for blast cleaning paint from a target composite surface without damaging the underlying composite surface, including producing said substantially continuous media flow at a pressure of 40 pounds per square inch or less at a media outlet, and directing said media flow at the target composite surface whereby paint is removed by the action of said media flow.

2. A method as in claim 1 including providing a nozzle at said media outlet which confines said media flow to a portion of said target composite surface, and then directing said media flow in a varying manner over said target composite surface until the paint to be cleaned from said target composite surface is removed.

3. A method as in claim 2 in which said step of accelerating said media using media propelling means further includes directing the resultant media flow along a flexible tube toward said nozzle such that said nozzle is freely movable with respect to said target composite surface.

4. A method as in claim 3 including the step of maintaining the target composite surface stationary while moving said nozzle to direct said media flow in a varying manner over said target composite surface.

5. A method as in claim 1 which said step of directing said media flow at a target composite surface includes selecting an optimal path of media flow against said target composite surface by selecting the angle at which said media flow strikes said target composite surface to optimize the removal of paint.

6. A method as in claim 5 including the steps of providing a nozzle at said media outlet which confines said media flow to a portion of said target composite surface, and directing said media flow over said target composite surface by moving said nozzle with respect to said target composite surface, including maintaining a substantially optimal path of media flow while redirecting said media flow over said target composite surface.

7. A method as in claim 6 in which said step of directing said media flow over said target composite surface while maintaining a substantially optimal path of media flow further includes providing a pattern of direction for said media flow which includes directing said media flow primarily at areas of paint remaining to be removed and redirecting said media flow when removal is substantially accomplished to other areas of paint remaining to be removed in a substantially continuous cycle whereby exposure of cleaned areas of said target composite surface to said media flow is minimized.

8. A method as in claim 6 in which said step of accelerating said media using media propelling means further includes directing the resultant media flow along a flexible tube toward said nozzle such that said nozzle is freely movable with respect to said target composite surface.

9. A method as in claim 8 further including varying the direction of said media flow with respect to said target composite surface in a substantially continuous manner until the paint to be cleaned are removed from the entire target composite surface.

10. A method as in claim 8 including the step of maintaining the target composite surface stationary while moving said nozzle to direct said media flow in a varying manner over said target composite surface.

11. A method as in claim 5 in which the selection of an optimal path of media flow includes increasing the angle away from a perpendicular direction at which said media flow strikes said target composite surface until the effectiveness of the media flow in removing paint is maximized.

12. A method as in claim 1 in which said step of accelerating said media using media propelling means includes pressurizing said media means of pneumatic pressure.

13. A method as in claim 1 in which said step of providing a granular plastic media includes providing a media formed of granular particles of urea formaldehyde.

* * * * *